US006949172B1

(12) United States Patent
Hosten et al.

(10) Patent No.: US 6,949,172 B1
(45) Date of Patent: Sep. 27, 2005

(54) ARRANGEMENT ENABLING A LIQUID TO FLOW EVENLY AROUND A SURFACE OF A SAMPLE AND USE OF SAID ARRANGEMENT

(75) Inventors: Daniel Hosten, Handzam (BE); Helge Schmidt, Speyer (DE); Michael Schwab, Markdorf (DE)

(73) Assignee: Tyco Electronics Logistics AG, Steinach (CH)

( * ) Notice: Subject to any disclaimer, the term of this patent is extended or adjusted under 35 U.S.C. 154(b) by 0 days.

(21) Appl. No.: 10/069,177

(22) PCT Filed: Aug. 10, 2000

(86) PCT No.: PCT/DE00/02704

§ 371 (c)(1),
(2), (4) Date: Jul. 2, 2002

(87) PCT Pub. No.: WO01/12882

PCT Pub. Date: Feb. 22, 2001

(30) Foreign Application Priority Data

Aug. 13, 1999 (DE) ..... 199 38 409

(51) Int. Cl.[7] ..... C25D 17/02; C25F 7/00
(52) U.S. Cl. ..... 204/275.1; 204/276; 204/224 R; 134/157
(58) Field of Search ..... 204/212, 275.1, 204/276, 224 R; 205/84, 118, 133, 123, 125; 118/416, 429; 134/137, 157

(56) References Cited

U.S. PATENT DOCUMENTS

| | | | | |
|---|---|---|---|---|
| 4,696,729 | A * | 9/1987 | Santini | 204/224 R |
| 5,443,707 | A | 8/1995 | Mori | |
| 5,597,460 | A | 1/1997 | Reynolds | |
| 5,932,076 | A * | 8/1999 | Gubig | 202/212 |
| 6,024,856 | A * | 2/2000 | Haydu et al. | 205/84 |
| 6,059,885 | A * | 5/2000 | Ohashi et al. | 118/730 |
| 6,475,627 | B1 * | 11/2002 | Ose | 428/446 |
| 6,539,963 | B1 * | 4/2003 | Dunn | 134/182 |
| 6,655,829 | B1 * | 12/2003 | Vanden Bussche et al. | 366/165.1 |
| 2001/0000477 | A1 * | 4/2001 | Harada | 427/534 |

FOREIGN PATENT DOCUMENTS

| | | |
|---|---|---|
| EP | 0 856 598 | 7/1997 |
| JP | 5033196 | 2/1993 |

* cited by examiner

*Primary Examiner*—Roy King
*Assistant Examiner*—Harry D. Wilkins, III
(74) *Attorney, Agent, or Firm*—Baker & Daniels LLP

(57) ABSTRACT

The invention relates to an arrangement enabling a liquid (2) to flow evenly around a surface of a sample (3); said arrangement has a flow chamber (1) through which a liquid (2) flows via inflow and outflow pipes (7, 8). The sample (3) can be rotated about an axis of rotation by means of a rotary drive (5). A filter (13) which extends crosswise to the direction of flow of the liquid (2) and which ensures a uniform flow through the inflow and outflow pipes (7, 8) is situated in front of the inflow and outflow pipes (7, 8). The arrangement is especially suitable for depositing a homogeneous layer of a nickel/iron alloy on a silicon wafer (3). The invention relates furthermore to the use of the arrangement.

18 Claims, 2 Drawing Sheets

ARRANGEMENT ENABLING A LIQUID TO FLOW EVENLY AROUND A SURFACE OF A SAMPLE AND USE OF SAID ARRANGEMENT

DESCRIPTION

Arrangement Enabling a Liquid to Flow Evenly Around a Surface of a Sample and Use of Said Arrangement The invention relates to an arrangement enabling a liquid to flow evenly around a surface of a sample, with the sample rotating in said liquid. In addition thereto, the invention relates to the use of said arrangement.

Such arrangements are employed in particular for electroprocessing surfaces, in which a sample connected to the cathode as well as an anode are arranged opposite each other in an electrolyte. It is desirable in electrodeposition in this regard that the deposited layers be homogeneous across the coated surface with respect to layer thickness and other functional properties, such as intrinsic stress. This necessitates a uniform transfer of the substance dissolved in the electrolyte to the layer surface.

The document EP 0 856 598 A1 discloses an apparatus for electroplating a surface, in which a rotating sample is laterally subjected to the flow of the electrolyte through a nozzle. Due to the rotating sample, a homogeneous layer thickness may be obtained by averaging. The disadvantage of this arrangement consists in that the flow discharged from the nozzle is not laminar. The thus caused formation of eddies results in non-uniform deposition rates. Furthermore, the non-uniform flow also affects the anode on which the material to be deposited dissolves in the electrolyte. With non-uniform flow to the anode, there may occur ion concentration differences within the electrolyte.

Furthermore, there are arrangements known for electrodeposition of layers in which a sample at rest is arranged in a flow cell. With the flow cell, the flowing in and flowing out liquid is passed through a plurality of small tubes arranged in parallel. This arrangement thus attempts to create an as uniform as possible flow in the cell. The disadvantage of this arrangement consists in that particles present on the sample at rest may cause flow shadows. In addition thereto, partially occurring inhomogeneities in the electric field between anode and cathode are not compensated due to the sample at rest.

It is thus an object of the present invention to make available an arrangement enabling a uniform flow of a liquid around a surface of a sample in which flow eddies or turbulences, flow shadows and inhomogeneities due to a sample at rest are avoided and in which the flow across the surface is of laminar nature.

According to the invention, this object is met by an arrangement according to claim 1. Advantageous developments of the invention as well as uses of the invention are indicated in the further claims.

The invention indicates an arrangement enabling a liquid to flow evenly around a surface of a sample, comprising a flow chamber through which said liquid flows. In said flow chamber, a sample is provided at least in part and can be rotated about an axis of rotation by means of a rotary drive. Starting from an inflow container and an outflow container, inflow pipes and outflow pipes, respectively, extend from and to opposite ends of the flow chamber. The pipes start from the respective containers.

The liquid is supplied to the inflow container via an inflow tube. The liquid is discharged from the outflow container via an outflow tube beginning in the latter. The inflow and outflow containers just have a manifold function from the tubes to the pipes. The arrangement furthermore has means suitable for generating a flow. In addition thereto, the arrangement has filters through which said liquid flows at a location of said arrangement. These filters are arranged either in the inflow and outflow containers, respectively, or in the inflow and outflow pipes, respectively.

Due to the combination of a flow cell and a filter having the liquid flowing therethrough, according to the invention, and due to the homogeneous flow in the inflow and outflow pipes resulting therefrom, a laminar flow around the surface is obtained together with a rotating sample. The effect achieved furthermore is that inhomogeneities occurring due to a stationary sample are avoided.

A particularly homogeneous flow around the surface is obtained according to the invention in that the pores of the filter or filters are set such that, with respect to the size and number thereof, that the pressure differential between the inflow and outflow pipes, which have different distances from the inflow or outflow tube, is compensated. This is achieved preferably in that, in case of pipes further away from the inflow or outflow tube, a larger overall pore area of the associated filter or filter portion has liquid flowing therethrough as compared to pipes arranged close to the inflow or outflow tube.

The arrangement according to the invention may be used in particularly advantageous manner for electro-depositing or electro-removing material on or from the surface of a sample if the flow chamber has an electrode arranged therein and the liquid is an electrolyte. The sample and the electrode are connected to a current source. It is possible to employ a dc current source the polarity of which is chosen in correspondence with the application for depositing or removing. The current source moreover may also be of pulsating nature, thereby permitting also the deposition of mechanically twisted layers on the sample surface.

Particularly advantageous is an arrangement for electro-depositing or electro-removing material on or from a surface of a sample, in which according to the invention the flow chamber has two mutually parallel planar confining walls. The confining walls have a first and a second recess, respectively. The sample has a substantially planar surface and is arranged to be rotatable about an axis of rotation perpendicular to said surface, such that this surface covers the first recess, with the surface defining a plane together with the associated confining wall. The electrode has a planar surface as well, covering the second surface and defining a plane with the associated confining wall. The flow chamber in this case is confined by planar confining walls extending parallel to the inflow and outflow pipes, which further encourages the formation of a laminar flow.

Particularly advantageous is an arrangement for electro-depositing material, in which according to the invention the anode is a grid basket of electrochemically inert material, which has a planar surface containing holes. This grid basket is filled with the material to be deposited, which is in granular form. Due to the granular form of the material to be deposited, the area of contact with the electrolyte is especially large, whereby the material to be deposited dissolves more easily in the electrolyte.

In addition thereto, it is especially advantageous if the electrode consists of a metal coated with platinum or another noble metal. In this case, material to be deposited will be re-furnished solely by substitution of the spent electrolyte. The electrolyte or the usually aqueous solvent thereof will then be decomposed at the anode. A possible electrochemical reaction with an electrolyte containing dissolved nickel would be, for example, the deposition of nickel on the cathode and the simultaneous generation of oxygen from the water of the solution at the anode.

Especially advantageous is an arrangement enabling a liquid to flow evenly around a surface of a sample, in which according to the invention the inflow and outflow tubes each extend via a throttle valve into a supply container filled with liquid. Suitable means for generating a flow in this regard is a liquid pump pumping the liquid of the supply container through the inflow tube. Furthermore, the supply container contains means for filtering and for regulating the temperature, the pH value and the filling level of the liquid. In the event that the liquid is an electrolyte, there are provided moreover means for regulating the ion concentration of the electrolyte.

It is thus rendered possible, for example, to control a coating process with very high accuracy, since monitoring and control of the relevant parameters of temperature, pH value and ion concentration of the electrolyte are favorable for homogeneous layer deposition.

The invention may be employed in particularly advantageous manner for depositing a mechanically twisted layer of a nickel/iron alloy on a wafer. This wafer then consists preferably of silicon or ceramics. The effect achievable by use of the arrangement according to the invention is that the composition of the alloy and the intrinsic mechanical stress of the layer is homogeneous across the wafer. By patterning rectangles that are subsequently etched back in part, springs bent away from the wafer may be produced from the deposited layer in a batch process. Such springs are utilized, for example, in miniaturized relays.

The arrangement according to the invention may also be utilized in particularly advantageous manner for applying electrophoretic varnish or resist to wafers. The voltage required for electrophoresis is applied between the wafer and an opposing electrode.

Furthermore, the arrangement according to the invention may also be used very advantageously for electroless or autocatalytic deposition of material on the surface of the sample.

In addition thereto, the arrangement according to the invention may also be used for removing material from the surface of the sample with the aid of an etching solution. For example, the surface of a silicon wafer could be etched with KOH solution.

In the following, the invention will be elucidated in more detail by way of embodiments and the associated drawing figures.

Figure 1:
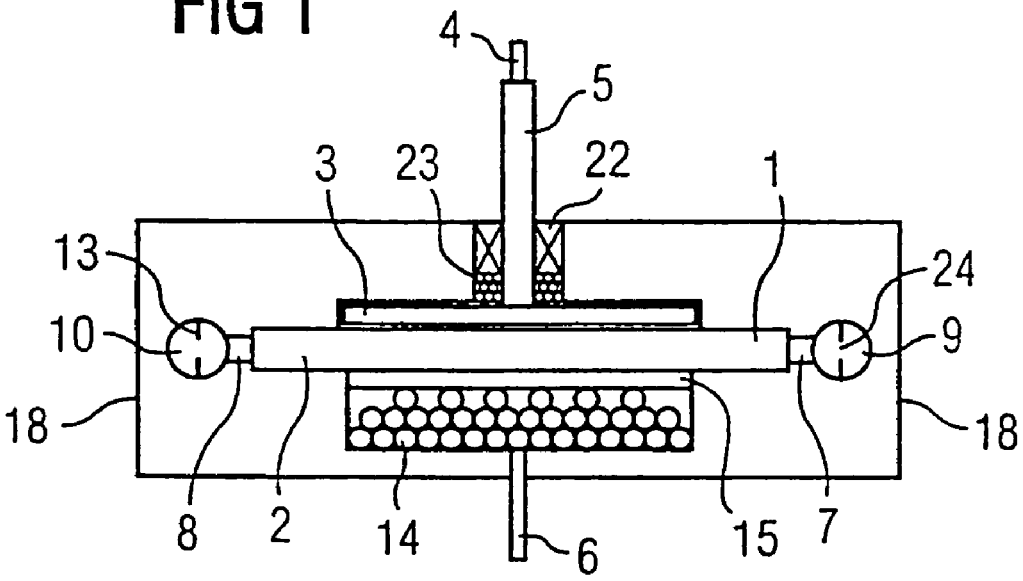
FIG. 1 illustrates a schematic longitudinal sectional view of an arrangement according to the invention enabling a liquid to flow around a surface.

FIG. 1 illustrates an arrangement enabling a uniform flow around a surface, comprising a flow chamber 1 having an electrolyte 2 provided therein. A wafer 3 is arranged on the upper side of the flow chamber 1. The wafer 3 is connected to a cathode 4 and rotatable about an axis perpendicular to its surface by means of a rotary drive 5. The rotary drive 5 is supported by means of bearing 22 and sealed with respect to the wafer with the aid of gasket 23. Arranged opposite the wafer 3 is a grid basket 15 connected to an anode 6 and containing the material to be deposited in the form of granulate 14. Flow chamber 1 is surrounded by a casing 18. Arranged laterally on each side of said flow chamber 1 are an inflow container 9 and an outflow container 10, respectively. Containers 9, 10 are connected to flow chamber 1 via inflow pipes 7 and outflow pipes 8, respectively. The inflow container 9 and the outflow container 10 each have a filter 13 arranged therein. This filter 13 provides for as uniform flow as possible through inflow pipes 7 and outflow pipes 8. The filter 13 has filter pores 24 allowing the electrolyte 2 to flow therethrough.

Figure 2:
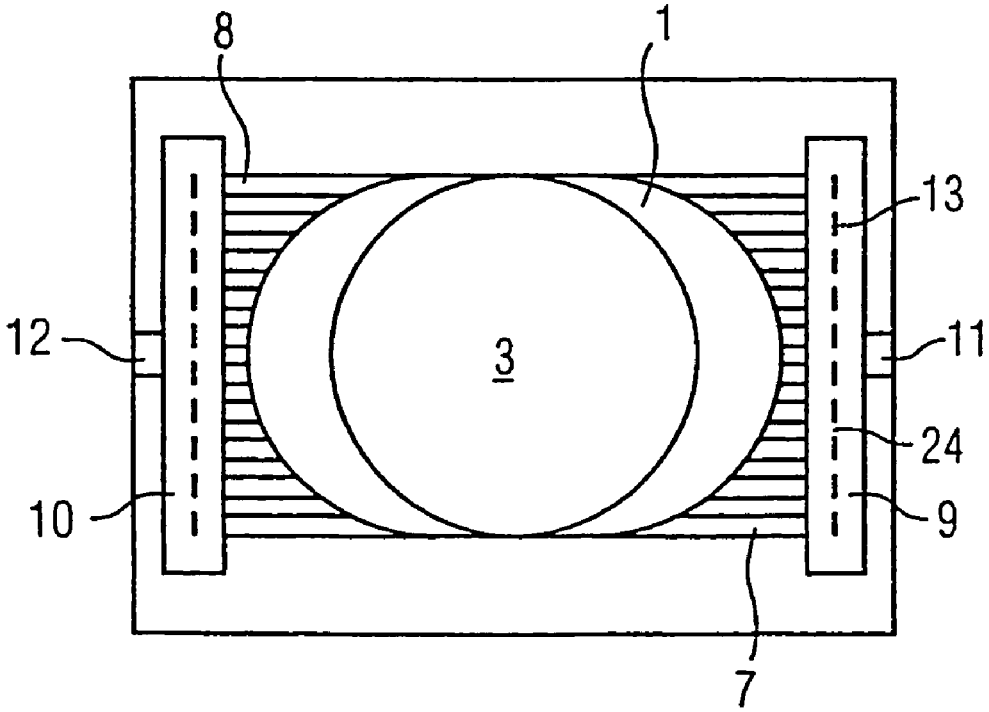
FIG. 2 illustrates a schematic transverse sectional view of a flow chamber of an arrangement enabling a liquid to flow evenly around a surface, according to the invention.

FIG. 2 shows a flow chamber 1 covered on the upper side by a wafer 3. Laterally of flow chamber 1, there are arranged an inflow container 9 and an outflow container 10. The inflow container 9 has an inflow tube 11 terminating therein which transports liquid into inflow container 9. The outflow container 10 has an outflow tube 12 beginning therein which transports liquid away from outflow container 10. The flow chamber 1 is connected to inflow container 9 and outflow container 10 via parallel extending inflow pipes 7 and outflow pipes 8, respectively. Inflow container 9 and outflow container 10 have a filter 13 with filter pores 24 arranged therein. The size of the filter pores 24 is selected to vary across the overall filter area such that the pressure differential between inflow pipes 7 and outflow pipes arranged at different distances from the inflow tube 11 and the outflow tube 12, respectively, is compensated. This provides for uniform flow through the inflow pipes 7 and the outflow pipes 8, which favors a laminar flow in flow chamber 1.

Figure 3:
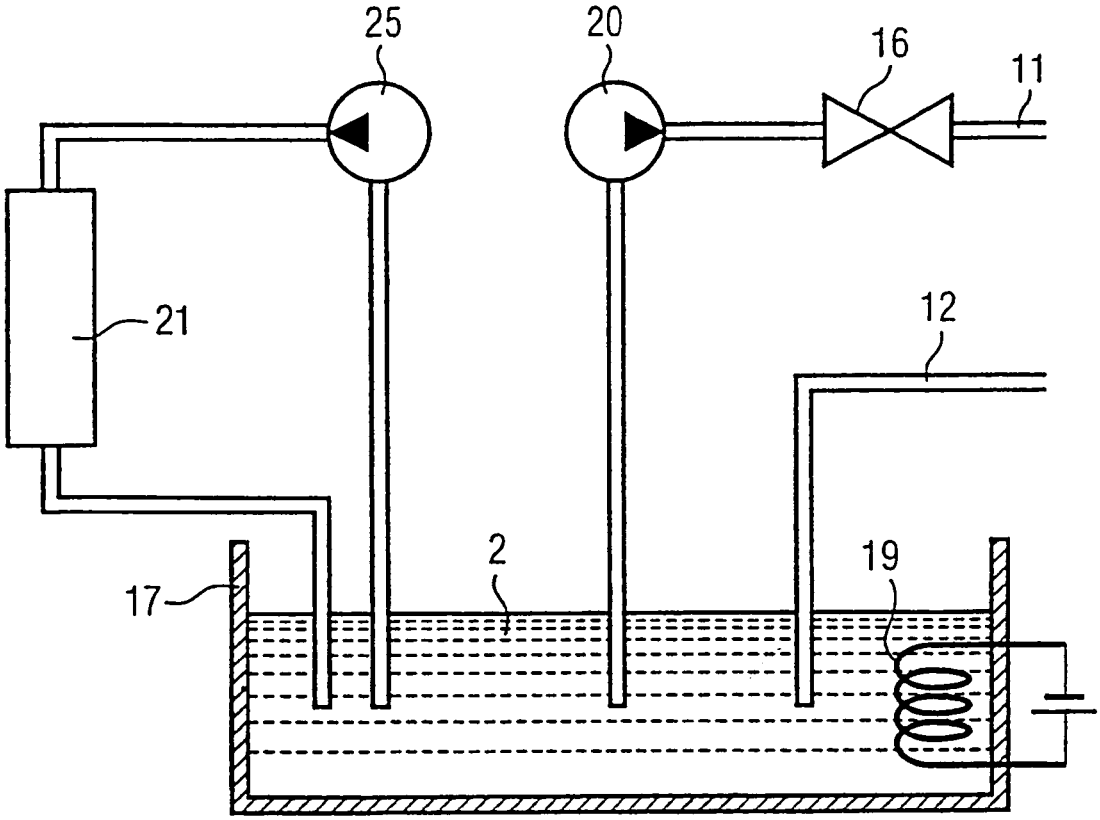
FIG. 3 illustrates a schematic longitudinal sectional view of a supply container having an inflow tube and an outflow tube introduced therein.

FIG. 3 illustrates a supply container 17 filed with electrolyte 2 and having an outflow tube 12 and an inflow tube 11 extending thereinto. Inflow tube 11 is passed into supply container 17 via a throttle valve 16. Conveying pump 20 is used as means for generating a flow. Arranged in supply container 17 is a heater 19 used for regulating the temperature. By means of an additional conveying pump 25 and a filter cartridge 21, the electrolyte 2 from supply container 17 can be cleaned in a continuous process.

With the aid of the rotary drive and the conveying pump, the rotational speed of the wafer and the flow rate of the electrolyte can be matched to the desired process.

The invention is not restricted to the embodiments illustrated in exemplary form, but is defined in its most general form by claim 1.

What is claimed is:

1. An arrangement enabling a liquid to flow evenly around a surface of a sample, said arrangement comprising:

a flow chamber having said liquid flowing therethrough, a sample located at least in part in said flow chamber and rotatable about an axis of rotation by means of a rotary drive, a plurality of inflow pipes and a plurality of outflow pipes extending into opposing ends of said flow chamber from an inflow container and an outflow container, respectively, an inflow tube terminating in the inflow container, an outflow tube beginning in the outflow container, a flow generator, and filters arranged in the inflow and/or outflow container or in the inflow and outflow pipes, respectively, and having the liquid flowing therethrough.

2. An arrangement enabling a liquid to flow evenly around a surface of a sample, said arrangement comprising:

a flow chamber having said liquid flowing therethrough, a sample located at least in part in said flow chamber and rotatable about an axis of rotation by means of a rotary drive, inflow and outflow pipes each extending to opposite ends of the flow chamber from inflow and outflow containers, respectively, an inflow tube terminating in the inflow container, an outflow tube beginning in the outflow container, a flow generator, and filters arranged in the inflow and/or outflow container or in the inflow and outflow pipes, respectively, and having the liquid flowing therethrough, wherein the inflow and outflow pipes extend in opposite ends of the flow chamber and the outflow tube begins in the outflow container and, wherein the filters include a plurality of filter pores having a size and a number set to be varying across the overall filter area such that a pressure differential between the inflow/outflow pipes arranged at different distances from the inflow/outflow tube, which causes non-uniform flow through said pipes, is compensated by different overall pore areas associated with the individual pipes.

3. An arrangement according to claim 2, for electro-depositing or electro-removing material on or from the surface of the sample, comprising an electrode in the flow chamber, wherein the liquid is an electrolyte and wherein the sample and the electrode are connected to a pulsating or constant current source.

4. An arrangement enabling a liquid to flow evenly around a surface of a sample and for electro-depositing or electro-removing material on or from the surface of the sample, said arrangement comprising:

a flow chamber having said liquid flowing therethrough and two planar confining walls arranged parallel to the direction of flow and having a first and second recess, respectively, an electrode in the flow chamber, a sample located at least in part in said flow chamber and rotatable about an axis of rotation by means of a rotary drive and having a substantially planar surface having said axis of rotation arranged perpendicular thereto, inflow and outflow pipes each extending to opposite ends of the flow chamber from inflow and outflow containers, respectively, an inflow tube terminating in the inflow container, an outflow tube beginning in the outflow container, a flow generator, and filters arranged in the inflow and/or outflow container or in the inflow and outflow pipes, respectively, and having the liquid flowing therethrough, wherein the inflow and outflow pipes extend in opposite ends of the flow chamber and the outflow tube begins in the outflow container, wherein the liquid is an electrolyte and the sample and the electrode are connected to a pulsating or constant current source, and the electrode covers the second recess with a planar surface and defines a plane with the associated confining wall.

5. An arrangement according to claim 4, wherein the electrode has a grid basket of electrochemically inert material that is filled with the material to be deposited in granular form and has a planar surface containing holes.

6. An arrangement according to claim 4, wherein the electrode consists of a metal body having a planar surface and coated with platinum or another noble metal.

7. An arrangement enabling a liquid to flow evenly around a surface of a sample, said arrangement comprising:

a flow chamber having said liquid flowing therethrough, a sample located at least in part in said flow chamber and rotatable about an axis of rotation by means of a rotary drive, inflow and outflow pipes each extending to opposite ends of the flow chamber from inflow and outflow containers, respectively, an inflow tube terminating in the inflow container, an outflow tube beginning in the outflow container, a flow generator, and filters arranged in the inflow and/or outflow container or in the inflow and outflow pipes, respectively, and having the liquid flowing therethrough, wherein the inflow and outflow pipes extend in opposite ends of the flow chamber and the outflow tube begins in the outflow container and the inflow and/or outflow tube extends via a throttle valve into a supply container filled with liquid, said supply container having means for filtering as well as for regulating the temperature, the pH value, the filling level and optionally also the ion concentration of the liquid.

8. An arrangement according to claim 7, wherein said material for electro-depositing is a nickel/iron alloy and said sample is a silicon or ceramic wafer, whereby a layer of the alloy has a composition and an intrinsic mechanical stress that is homogeneous across the wafer.

9. An arrangement according to claim 7, wherein said material for electro-depositing is an electrophoretic photoresist material.

10. An arrangement according to claim 7, wherein said liquid is deposited on the surface of the sample without the use of an electrode.

11. An arrangement according to claim 7, wherein said liquid is an etching solution for removing material from the surface of the sample.

12. An arrangement enabling a liquid to flow evenly around a surface of a sample, said arrangement comprising a flow chamber profiled for allowing liquid to flow therethrough, a rotary drive mechanism having a sample mounting surface profiled relative to said flow chamber whereby a sample can be located at least in part in said flow chamber and rotatable about an axis of rotation by said rotary drive mechanism, an inflow manifold and an outflow manifold positioned on opposite ends of said flow chamber, each manifold having flow tubes extending from said respective manifold and into said flow chamber, said manifolds and said flow tubes defining a laminar flow pattern through said flow chamber.

13. The arrangement of claim 12, further comprising filters arranged in the inflow and/or outflow container or in the inflow and outflow pipes, respectively, and having the liquid flowing therethrough.

14. An arrangement enabling a liquid to flow evenly around a surface of a sample, said arrangement comprising a flow chamber profiled for allowing liquid to flow therethrough, a rotary drive mechanism having a sample mounting surface profiled relative to said flow chamber whereby a sample can be located at least in part in said flow chamber and rotatable about an axis of rotation by said rotary drive mechanism, an inflow manifold and an outflow manifold positioned on opposite ends of said flow chamber, each manifold having flow tubes extending from said respective manifold and into said flow chamber, said manifolds and said flow tubes defining a laminar flow pattern through said flow chamber and wherein the size and the number of the filter pores is set to be varying across the overall filter area such that a pressure differential between the inflow/outflow pipes arranged at different distances from the inflow/outflow tube, which causes non-uniform flow through said pipes, is compensated by different overall pore areas associated with the individual pipes.

15. An arrangement according to claim 14 for electro-depositing or electro-removing material on or from the surface of the sample, comprising an electrode in the flow chamber, wherein the liquid is an electrolyte and wherein the sample and the electrode are connected to a pulsating or constant current source.

16. An arrangement enabling a liquid to flow evenly around a surface of a sample for electro-depositing or electro-removing material on or from the surface of the sample, said arrangement comprising:

a flow chamber profiled for allowing liquid to flow therethrough and having two planar confining walls arranged parallel to the direction of flow and having a first and a second recess, respectively, a rotary drive mechanism having a sample mounting surface profiled relative to said flow chamber whereby a sample can be located at least in part in said flow chamber and rotatable about an axis of rotation by said rotary drive mechanism and the sample having a substantially planar surface having said axis of rotation arranged perpendicularly thereto, an inflow manifold and an outflow manifold positioned on opposite ends of said flow chamber, each manifold having flow tubes extending from said respective manifold and into said flow chamber, said manifolds and said flow tubes defining a laminar flow pattern through said flow chamber, wherein the sample covers the first recess and said planar surface defines a plane with the associated confining wall, and the electrode covers the second recess with a planar surface and defines a plane with an associated confining wall.

17. An arrangement according to claim 16, wherein the electrode has a grid basket of electrochemically inert material that is filled with the material to be deposited in granular form and has a planar surface containing holes.

18. An arrangement according to claim 16, wherein the electrode consists of a metal body having a planar surface and coated with platinum or another noble metal.

* * * * *

UNITED STATES PATENT AND TRADEMARK OFFICE

CERTIFICATE OF CORRECTION

PATENT NO. : 6,949,172 B1
DATED : September 27, 2005
INVENTOR(S) : Daniel Hosten et al.

It is certified that error appears in the above-identified patent and that said Letters Patent is hereby corrected as shown below:

Column 8,
Line 11, delete "the electrode covers" and insert -- an electrode that covers --.

Signed and Sealed this

Sixth Day of December, 2005

JON W. DUDAS
*Director of the United States Patent and Trademark Office*